United States Patent [19]

Ferguson et al.

[11] Patent Number: 4,806,229

[45] Date of Patent: Feb. 21, 1989

[54] VOLATILE AMINES FOR TREATING REFINERY OVERHEAD SYSTEMS

[75] Inventors: Sam Ferguson, Sugar Land; Kathryn G. Burns; Russell C. Strong, both of Richmond, all of Tex.

[73] Assignee: Nalco Chemical Company, Naperville, Ill.

[21] Appl. No.: 915,953

[22] Filed: Oct. 3, 1986

Related U.S. Application Data

[63] Continuation of Ser. No. 768,266, Aug. 22, 1985, abandoned.

[51] Int. Cl.[4] ..... C10G 7/10

[52] U.S. Cl. ..... 208/47; 208/347; 208/356; 208/262.1; 203/7; 585/950

[58] Field of Search ..... 208/47, 262, 356, 347; 203/7; 423/228, 229; 585/950

[56] References Cited

U.S. PATENT DOCUMENTS

| | | | |
|---|---|---|---|
| 2,889,276 | 6/1959 | Barrett et al. | 422/12 |
| 2,911,351 | 11/1959 | Hill | 208/47 |
| 2,938,851 | 5/1960 | Stedman et al. | 208/47 |
| 3,003,955 | 10/1961 | Jones | 252/855 E |
| 3,284,344 | 11/1966 | Demeester et al. | 208/262 |
| 3,447,891 | 6/1969 | Crawford | 422/9 |
| 3,458,453 | 7/1969 | Kautsky | 203/7 |
| 3,516,922 | 6/1970 | Anzilotti | 252/855 E |
| 3,583,901 | 6/1971 | Piehl | 585/950 |
| 3,676,327 | 7/1972 | Foroulis | 208/47 |
| 3,779,905 | 12/1973 | Stedman | 203/7 |
| 3,919,054 | 11/1975 | Hands | 203/7 |
| 3,923,606 | 12/1975 | Haussler | 252/855 E |
| 3,981,780 | 9/1976 | Scherrer et al. | 203/7 |
| 4,062,764 | 12/1977 | White et al. | 208/348 |
| 4,335,072 | 6/1982 | Barnett et al. | 203/7 |
| 4,461,749 | 7/1984 | Thorn | 423/228 |
| 4,483,834 | 11/1984 | Wood | 423/228 |
| 4,514,281 | 4/1985 | Baumert et al. | 208/262 |

OTHER PUBLICATIONS

Mann et al., "Organic Inhibitors of Corrosion", pp. 159–163 (Feb. 1936).

*Industrial & Engineering Chemistry*, 32, (1940) p. 802, et seq.

"Fatty Acids" by K. Markley, Interscience Publishers, New York, 1947, pp. 328–330.

Memo to J. Premo dated Jul. 27, 1985, by Sam Ferguson.

*Primary Examiner*—Anthony McFarlane

*Attorney, Agent, or Firm*—John G. Premo; Anthony L. Cupoli; Donald G. Epple

[57] ABSTRACT

A process for substantially neutralizing the volatile acid gases and water present in the condensate of a distilling pertroleum product which comprises treating the distilling product prior to the condensation thereof with at least one amine having a boiling point below 95° C. in an amount sufficient to substantially neutralize all of the volatile acid gases present with said petroleum product

7 Claims, 4 Drawing Sheets

Figure 1:
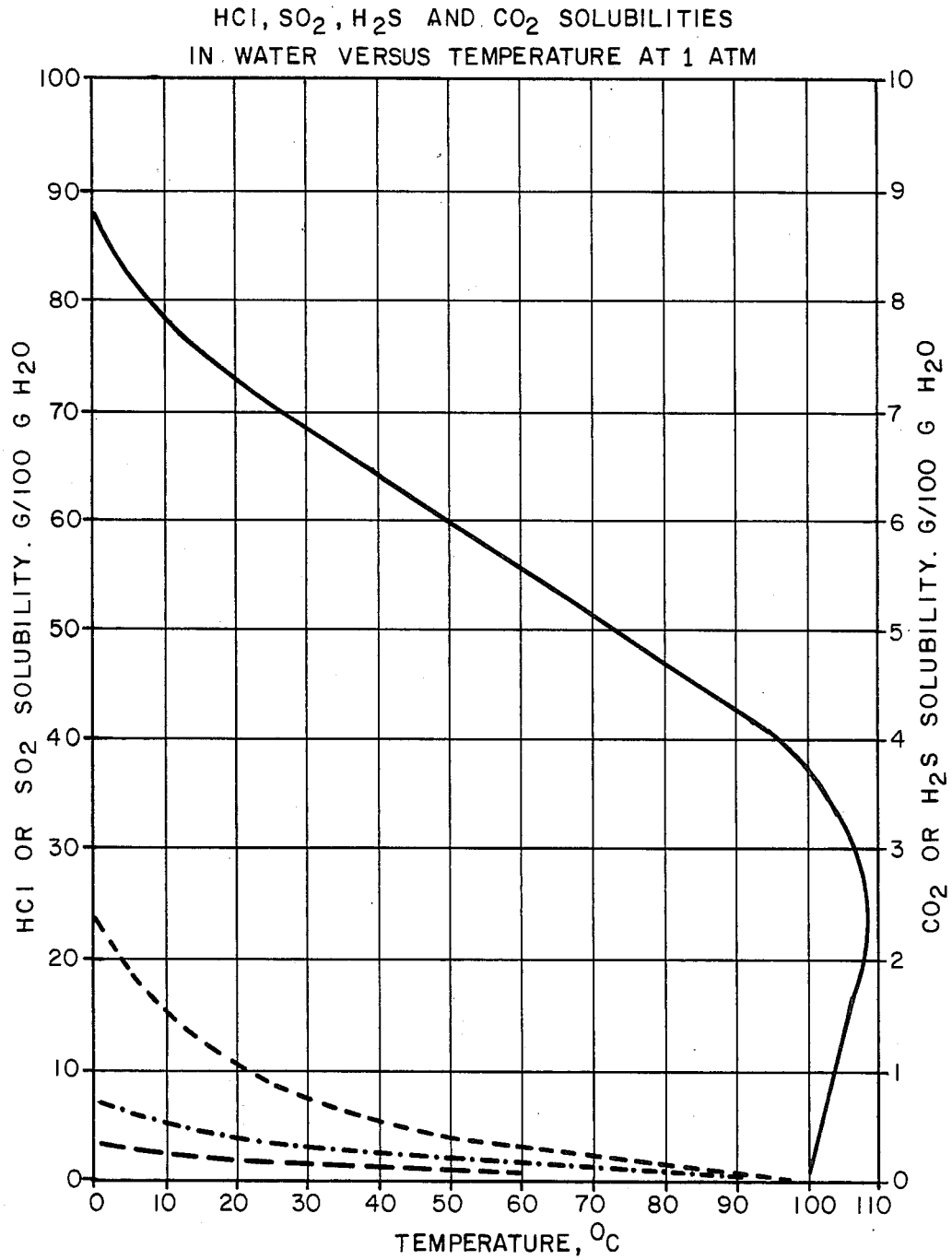

(1) VAN NUYS, TRANS. AM. INST. CHEM. ENG. V. 39, P663, 1943,
(2) PERRY & CHILTON'S CHEM. ENG.'S HANDBOOK,
(3) LANGE'S HANDBOOK OF CHEM.

—— HCl (1)
- - - $SO_2$ (2)
-·-·- $H_2S$ (3)
— — $CO_2$ (3)

AQUEOUS CONDENSATION PROFILES

IRON CHROMATOGRAM

COMPARATIVE CORROSION RATES
DEW POINT NEUTRALIZER VS. DEW POINT + $SO_2$ NEUTRALIZER

VOLATILE AMINES FOR TREATING REFINERY OVERHEAD SYSTEMS

This is a continuation of Ser. No. 768,266, filed 8-22-85, abandoned.

INTRODUCTION

Petroleum crudes as well as gas oil, reduced crude, etc., are subjected to various processes in order to form lower boiling components such as gasoline. The product that is obtained from conversion is distilled to produce a gasoline fraction, a fuel oil fraction, lubricating oil fraction, etc. The lower boiling fractions, and particularly gasoline, are recovered as an overhead fraction from the distilling zones. The intermediate components are recovered as side cuts from the distillation zone. The fractions are cooled, condensed, and sent to collecting equipment. No matter what the source of the oil that is subject to distillation, it has been found that corrosion of the equipment takes place. Acidic materials that are formed in the processing of petroleum are carried along from the distillation zone with the distillate product and often cause extensive corrosion to take place on the metal surfaces of fractionating systems such as crude towers, trays within such towers, heat exchangers, receiving tanks, connecting pipes, etc. The most serious corrosion occurs in condensers and in the overhead line leading from the fractionating towers. The overhead line is used as a connection between the distillation tower and condensers. The distillate or stock which will be stored or used subsequently to charge other refining processes is condensed on the cooled surfaces of the condenser equipment and is then caught in an overhead accumulator drum. A portion of the distillate is recycled to the crude tower with the remainder being transferred to other refinery units.

One of the chief points of difficulty with respect to corrosion occurs in the area of the initial condensation of water. The term "initial condensate" as it is used herein signifies a phase formed when the temperature of the surrounding environment reaches the dew point of water. At this point a mixed phase of liquid water, hydrocarbon, and vapor may be present. Such initial condensate may occur within the distilling unit itself or in subsequent conductors. The top temperature of the fractionating column is normally maintained above the dew point of water. The initial condensate formed after the vapor leaves the column contains a high percentage of an acidic material such as HCl. Due to the high concentration of acids dissolved in the water, the pH of the first condensate is quite low. For this reason, the water is highly corrosive. It is important, therefore, that the first condensate be rendered less corrosive.

In the past, ammonia has been added at various points in the distillation circuit in an attempt to control the corrosiveness of condensed acidic materials. Ammonia, however, has not proven to be effective with respect to eliminating corrosion occurring at the initial condensate. It is believed that ammonia has been ineffective for this purpose because it does not condense quickly enough to neutralize the acidic components of the first condensate.

When using certain film-forming amines, it has been found that a far more economical system is set up where the pH of the condensed liquids is maintained above about 4.5, and preferably, at least about 5.0. This is true of virtually all amine film-forming inhibitors. A corrosion inhibitor of the film-forming type should be soluble in both aliphatics and aromatics in order to be dispersed throughout the stock. The inhibitors also should not tend to promote emulsification of the aqueous or hydrocarbon phases.

At the present time, morpholine is used successfully to control or eliminate corrosion that ordinarily occurs at the point of initial condensate within or after the distillation unit. The addition of morpholine to the petroleum fractionating system substantially raises the pH of the initial condensate rendering the material noncorrosive or substantially less corrosive than was previously possible. The inhibitor can be added to the system either in pure form or as an aqueous solution. A sufficient amount of morpholine is added to raise the pH of the liquid at the point of initial condensate to above 4.5 and, preferably, to at least about 5.0.

The use of morpholine either alone or in combination with so-called film-forming inhibitors is disclosed and claimed in U.S. Pat. No. 3,447,891, the disclosure of which is made a part hereof.

Commercially, morpholine has proven itself to be successful in treating many crude distillation units. In addition to using morpholine, other amines have been used, most notably cyclohexylamine either alone or in combination with morpholine. Another commercial product that has been used in these applications is hexamethylenediamine.

A specific problem has developed in connection with the use of these amines for treating the initial condensate. This problem relates to the hydrochloride salts of these amines which tend to form deposits in distillation columns, column pumparounds, overhead lines and in overhead heat exchangers. These deposits manifest themselves after the particular amine has been used for a period of time. Morpholine is the least offensive from a deposit standpoint but still forms deposits when used over protracted periods of time.

In order to overcome the deposit formation connected with the use of morpholine in these systems, it has been found that certain amines having the following formula corresponding to Formula 1 below:

$$R{-}O{-}(CH_2)_nNH_2 \qquad \text{Formula 1}$$

wherein n is 2 or 3 and R is a lower alkyl radical of not more than 4 carbon atoms, when added to a crude oil charge or at various other points in the system, effectively eliminates and/or controls corrosion that ordinarily occurs at the point of initial condensation of water vapors within or leaving the distilling unit. Illustrative of compounds falling within Formula 1 are methoxypropylamine (MOPA), ethoxypropylamine, methoxyethylamine, and the like. The most preferred compound is MOPA. The use of MOPA either alone or in conjunction with film-forming amines is disclosed in detail in U.S. Pat. No. 4,062,764, the disclosure of which is herein incorporated by reference.

In addition to controlling and preventing corrosion, MOPA has the distinct advantage of not forming deposits when used to treat such systems for prolonged periods of time.

MOPA can be added to the unit in any one of several places. First of all, MOPA can be added to the petroleum charge. This is a highly convenient method of carrying out the process since it will also neutralize condensate within the tower and in recirculating lines. The inhibitor can also be pumped directly into the gaseous overhead line. MOPA can also be passed into the reflux line or can be added to recirculating $H_2O$ into the gaseous overhead line. The particular point at which MOPA is added will depend largely on the design of the particular equipment, the personal preferences of the operator, and the point where corrosion is most severe.

As was pointed out above, the use of MOPA to control the corrosiveness of the initial condensate lends itself well to the joint use of film-forming corrosion inhibitors. Such film-forming inhibitors operate most economically at a pH above 4.5. Due to the fact that MOPA is particularly effective in increasing the pH of the initial condensate, the amount of film former that is required is substantially lessened.

Among the film-forming corrosion inhibitors which can be used in conjunction with MOPA to provide an overall system of protection are compounds formed by reacting certain aliphatic monoamines with polymerized fatty acids under salt-forming conditions.

The aliphatic monoamines used in preparing film-forming inhibitors are those amines having the general structural formula:

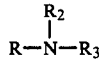

where R is an aliphatic hydrocarbon radical of 8 to 22 carbon atoms in chain length and both $R_2$ and $R_3$ are selected from the group consisting of hydrogen and an aliphatic hydrocarbon radical of 1 to 22 carbon atoms in chain length.

The above structural formula includes both primary and secondary aliphatic monoamines as well as the tertiary aliphatic monoamines. Illustrative compounds coming within the above general formula include such primary amines as n-dodecyl amine, n-tetradecyl amine, n-hexadecylamine, lauryl amine, myristyl amine, palmityl amine, stearyl amine, and oleyl amine. Other commercially available primary amines include coconut oil amine, tallow amine, hydrogenated tallow amine and cottonseed oil amine. Useful secondary amines are dilauryl amine, dimyristyl amine, dipalmityl amine, distearyl amine, dicoconut amine and dihydrogenated tallow amine. In the case of many of the above amines, it will be noted that the source of alkyl substituent on the organic nitrogen is derived from a mixed vegetable oil or animal fat. For purposes of convenience, these compounds have been named from the derivative alkyl-containing components. This system of nomenclature, particularly in the case of alkyl substituents derived from naturally occurring products such as fats, oils and the like, is used for purposes of simplification. It is believed that those familiar with the art will readily understand that the alkyl substituent varies in the case of a coconut substituent with the alkyl groups containing from 8 to 18 carbon atoms in chain length. Similarly, in the case of hydrogenated tallow, the alkyl substituent will vary from about 12 to 20 carbon atoms in chain length.

In addition to using primary or secondary amines as exemplified above, tertiary amines such as octyl dimethyl amine, octadecyl dimethyl amine, octadecyl methyl benzyl amine, hexyldiethylamine, trilaurylamine, tricoconut amine, tricaprylyl amine, and similar type compounds also may be used.

Preferred aliphatic primary monoamines are amines having the general structural formula:

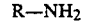

wherein R is an aliphatic hydrocarbon radical of from 8 to 22 carbon atoms in chain length. A preferred material of this type is the commercial product "Armeen SD" sold by the Armour Industrial Chemical Company which is known generically to the art as Soya amine. As applied to the above formula, the R group is a mixed aliphatic radical which has the following components:

| | Percent |
|---|---|
| Hexadecyl | 10 |
| Octadecyl | 10 |
| Octadecenyl | 35 |
| Octadecadienyl | 45 |

Out of the group of tertiary amines listed above, one of the most effective is dimethyl hydrogenated tallow amine. This preferred species may be considered as an ammonia molecule which has had its three hydrogen atoms replaced by three alkyl groups. Two of these alkyl groups are methyl and the third is a mixed alkyl substituent derived from hydrogenated tallow.

A representative analysis of the mixed radicals of the hydrogenated tallow group is as follows:

| | Percent |
|---|---|
| Myristic | 2 |
| Palmitic | 29 |
| Stearic | 68 |
| Oleic | 1 |

One of the preferred commercial sources of this tertiary amine is "Armeen $M_2HT$" sold by Armour Industrial Chemical Company.

The polymerized fatty acids are well known and have been described in numerous publications. Excellent descriptions of these materials may be found in Industrial and Engineering Chemistry, 32, page 802 et seq. (1940), and in the text "Fatty Acids" by Klare S. Markley, published by Interscience Publishers, Inc., New York City, 1947, pages 328 to 330. An specific example of such a polymer which has been found to be particularly useful is one which is prepared as a by-product of the caustic fusion of castor oil in the manufacture of sebacic acid. This material is composed primarily of dicarboxylic acids derived by bimolecular addition in an olefinic polymerization where linkage occurs through the opening of at least two unsaturated bonds. Typical properties of a material so obtained are as follows:

| | |
|---|---|
| Acid value | 150 |
| Saponification value | 172 |
| Unsaponifiable matter, percent | 3.7 |
| Iodine No | 36 |
| Moisture content, percent | 0.86 |

The material is, of course, not pure but predominantly contains dicarboxylate polymers having about 34 to 36 atoms. A suitable commercial source of this dimer acid is Harchem Division of Wallace and Tiernan, Inc., and is known as "Century D-75 Acid."

A typical film-forming corrosion inhibitor useful in conjoint activity with MOPA may be prepared by combining 1 weight part of "Armeen SD" and 2.57 weight parts of a polymerized fatty acid obtained as the residue of a dry distillation of castor oil with sodium hydroxide and reacting the mixture with stirring at a temperature of 60° C. for 20 minutes. The final reaction product is then dispersed in equal weight parts of a heavy aromatic solvent.

Another useful film-forming corrosion inhibitor composition is prepared by heating 14 parts of "Armeen $M_2HT$" to the melting point and adding thereto 36 parts of "Century D-75 Acid." The mixture was reacted for 10 minutes at 130°–150° F. and the resultant product added to a heavy aromatic solvent in equal proportions by weight of product to solvent.

| | | |
|---|---|---|
| Distillation range | mm. | 760 |
| Initial boiling point | °C. | 171 |
| Percent: | | |
| 10 | °C. | 184 |
| 50 | °C. | 230 |
| 90 | °C. | 260 |
| End point | °C. | 278 |

In reacting the above recited amines with polymerized fatty acids to obtain the film-forming compositions, care should be taken to maintain salt-forming conditions. This is done primarily by using reaction temperatures of from 25° to 100° C., and by avoiding the presence of materials which cause the splitting out of water. This environment is sometimes referred to as "neutralizing conditions." It is the salt producible from the above listed reactants which is of primary interest in the instant invention. Further care must be taken in conducting the reaction to eliminate the possibility of the presence of free amines in the final reaction product. Reaction proportions conducive to accomplishing this typically include the above recited use of a weight ratio of typical polymer to typical monoamine of 2.57:1.

Additional film-forming compositions that can be used in conjunction with the subject inhibitor include those disclosed in U.S. Pat. No. 3,003,955 among others.

Another class of a film-forming inhibitor compound is the salt formed between a carboxylic acid such as a fatty acid or a naphthenic acid and an amine such as ethylene diamine or a longer chain amine. An additional class of a film-forming inhibitor is an amide which may be formed by dehydrating the above amine-carboxylic acid salt. Another kind of a film-forming inhibitor is an amido-imidazoline which may be formed by vacuum dehydration of the di-amide formed from an amine such as diethylene triamine and various carboxylic acids such as tall oil fatty acids or naphthenic acids.

In addition to using MOPA or morpholine, it is possible to utilize other neutralizing amines. Such amines can be, for example, cyclohexylamine, ethylene diamine, propylenediamine, piperidine, piperazine, monoethanolamine, diethanolamine, N,N-dimethylethanolamine, N,N-diethylethanolamine, N,N-dimethylisopropanolamine, N-methylethanolamine, N-propylethanolamine, N-ethylethanolamine, N,N-dimethylaminoethoxyethanol, N,N-diethylaminoethoxyethanol, N-methyldiethanolamine, N-propyldiethanolamine, N-ethyldiethanolamine, t-butylethanolamine, t-butyldiethanolamine, 2-(2-aminoethoxy)ethanol, di-n-butylamine, tri-n-butylamine, di-iso-butylamine, ethyl-n-butylamine, pentylamine, 2-amino-2,3-dimethylbutane, 3-amino-2,2-dimethylbutane.

In addition to using the above neutralizing amines alone, they may be combined with each other or with film forming corrosion inhibitors.

Over the past few years, overhead systems have been undergoing a high corrosion rate even though amines such as MOPA, morpholine, monoethanolamine, ethylene diamine, N,N-dimethylethanolamine, N,N-diethylethanolamine, and N,N-dimethylisopropanolamine have been used to protect such equipment against this type of corrosion.

One of the most important aspects that forms an important part of the invention is the discovery that corrosion is not always found at the dew point in the system but can be much more severe at a temperature 10 or more degrees below the dew point temperature. At this temperature location in the equipment, more volatile acid gases such as $SO_2$, $H_2S$, and $CO_2$ begin to dissolve in water, as indicated in FIG. 1. Of these gases, $SO_2$ dissolved in water forms a strong acid. This fact is coupled with the discovery that this unwanted and unexpected corrosion always occurs when the source of petroleum used in the refining or petrochemical process contains sulfur or sulfur compounds. Due to the refining and distillation processes which are normally accompanied by the presence of water, the sulfur compounds are substantially converted to $H_2S$ and $SO_2$ which, upon dissolving with water, form various thionic acids. $CO_2$ is often a byproduct of petroleum processing and dissolves in water to form carbonic acid. Thus, even though materials such as MOPA and morpholine are condensing with the common corrosive element in this system, e.g., hydrochloric acid, they are not entirely effective for controlling the corrosion caused by the more volatile acids dissolving or forming in the cooler portions of these condensate systems. As indicated on FIG. 1, HCl is quite soluble in water above 100° C. due to its ability to azeotrope with water.

THE INVENTION

The invention comprises a process for neutralizing the volatile acid gases dissolving in the cooler condensate of a distilling petroleum product which comprises treating the distilling product prior to the condensation thereof with at least one amine having a normal boiling point below 95° C. in an amount sufficient to substantially neutralize all of the volatile acid gases present with said petroleum product. The use of the term, "substantially neutralize," refers to pH adjustment to 5.0 for the economical application of film forming inhibitors as has been previously mentioned. While describing the corrosiveness of the cooler sections as being occasioned by volatile acid gases which, when condensed, form sulfurous and carbonic acids, it will be understood that other corrosive non-volatile sulfur-containing acids can form such as, for example, thiosulfuric acid. However, for simplicity of description, such other acids will be included in the general term, either $SO_2$ or the sulfurous acid formed therefrom when it contacts water in these systems.

Whether the neutralization occurs in the vapor stage or in the aqueous phase or both is not known. It is known, however, that when the organic amines having the boiling points below 95° C. are used in such amounts as to neutralize substantially all of the $SO_2$ present, that corrosion is dramatically reduced or eliminated in the cooler sections of the refinery or petrochemical condensate systems being treated.

A preferred amine is dimethylamine. Other amines that can be used are: methylamine, ethylamine, n-propylamine, isopropylamine, diethylamine, triethylamine, trimethylamine, di-n-propylamine, di-isopropylamine, m-butylamine, sec-butylamine, 1-amino-2,2-dimethylpropane, 2-amino-2-methylbutane, 2-amino-3-methylbutane, 2-aminopentane, 3-aminopentane.

It is to be understood that these volatile amines are only representative of the class of compounds which may be used and that the invention is not necessarily limited thereto.

In another important embodiment of the invention, the organic amines having boiling points below 95° C. are combined with one or more than one of the neutralizing amines such as morpholine, MOPA, monoethanolamine, ethylenediamine, propylenediamine, N,N-dimethylethanolamine, N,N-diethylethanolamine, N,N-dimethylisopropanolamine, methoxyethylamine, piperidine, piperazine, N-methylethanolamine, cyclohexylamine, mixtures of N,N-dimethylethanolamine and N,N-dimethylisopropanolamine, mixtures of methoxypropylamine, monoethanolamine and morpholine, and mixtures of N,N-dimethylisopropanolamine and monoethanolamine, to provide a complete corrosion protection and prevention package. Similarly, they may be used in further combination with the film-forming inhibitors previously described.

The morpholine, MOPA, or other amines with normal boiling points at or above 95° C. typically neutralize the HCl in the initial condensate whereas the organic amines with normal boiling points below 95° C. operate upon the $SO_2$ and its correspondingly formed sulfurous acid condensing or dissolving in the cooler regions.

The amount of morpholine, MOPA, or other amine with boiling point at or above 95° C. used again will depend upon the quantity of HCl which is found in the system. A convenient method for determining the amount of HCl in these systems, as well as the amount of $SO_2$ present, is to utilize the well known analytical technique, Ion Exchange Chromatography. This well known analytical technique is described in the publication or article, "Separation of Sulfite, Sulfate and Thiosulfate by Ion Chromatography with Gradient Elution," Analytical Chem., Volume 55, 1983, pages 2–4.

Laboratory studies of the condensation profile of $H_2SO_3$ were set up using a specially designed glass distillation column and condenser. The hydrocarbon distillation apparatus was designed to simulate the top tray and overhead of a typical refinery crude oil distillation unit. The unit consisted of the following: a thermosiphoning reboiler; vacuum jacketed distillation column; ground glass jointed transfer lines; a multi-port condenser with thermometers and sample ports; and one or more receivers (accumulators).

Aqueous acid was fed into the column. Distilling naphtha from the reboiler vaporized the acid and produced steam and gaseous acid. Neutralizer was fed to the column's top tray or into the overhead line. Aqueous condensates were periodically drained from the bulbs and analyzed.

FIG. 1 illustrates the known solubility of HCl acid and of $SO_2$, $H_2S$ and $CO_2$ acid gases in water. HCl is quite soluble in water at atmospheric pressure above 100° C. due to its azeotrope with water. In contrast, gaseous $SO_2$, $H_2S$ and $CO_2$ are practically insoluble in water at 100° C. but became more soluble as the temperature is lowered below the normal boiling point of water. $SO_2$ solubility is higher than that from $H_2S$ or $CO_2$.

Figure 2:
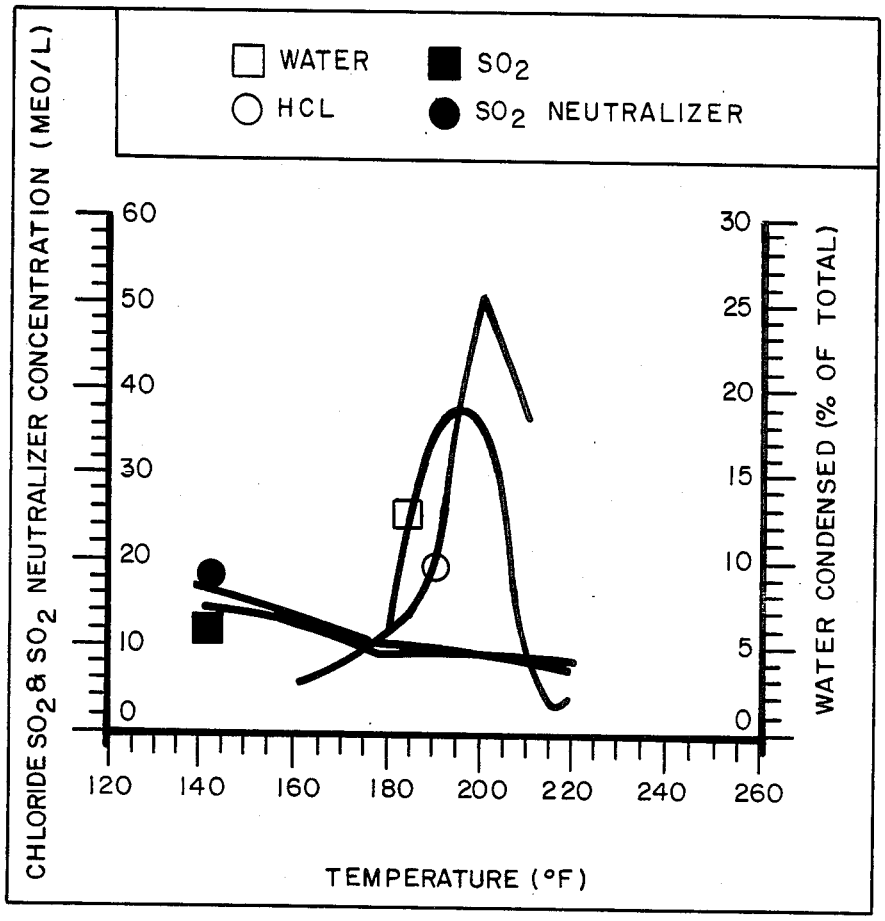

FIG. 2 shows what was found. Unlike HCl, $H_2SO_3$ condenses with increasing concentration in the cooler condensing water, i.e., water that condenses 10 or more degrees after the dew point of water. This matches the corrosion experiences on "problem" crude units.

Figure 3:
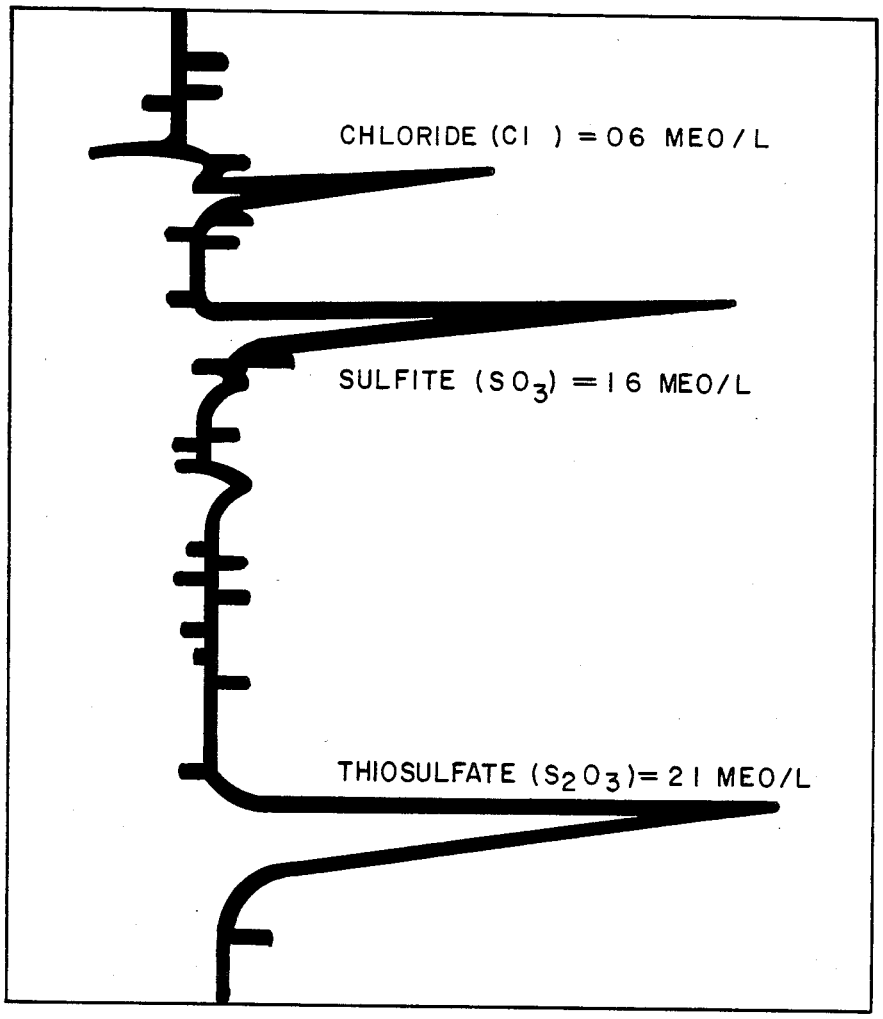

FIG. 3 is typical of the results from tailwater analysis by ion chromatography (I.C.) This particular sample was from a refinery crude unit and was only a few minutes old when it was analyzed. With the care taken to prevent aging and oxygen contamination, the I.C. shows that in this sample there is chloride ion (first major peak from HCl); sulfite (second major peak from sulfurous acid); and thiosulfate ion (third major peak from thiosulfuric acid). These patterns have been reproduced from not only other crude units but also from a laboratory crude unit furnace simulator. The presence of $H_2S_2O_3$ is explained by a reaction between $H_2S$ and $H_2SO_3$. Its formation is first dependent on the presence of $SO_2$.

A convenient method for determining the dosage of the chemical treatment discussed above is to add an amount sufficient to adjust the pH of the condensate formed between about 5.0–6.0.

Figure 4:
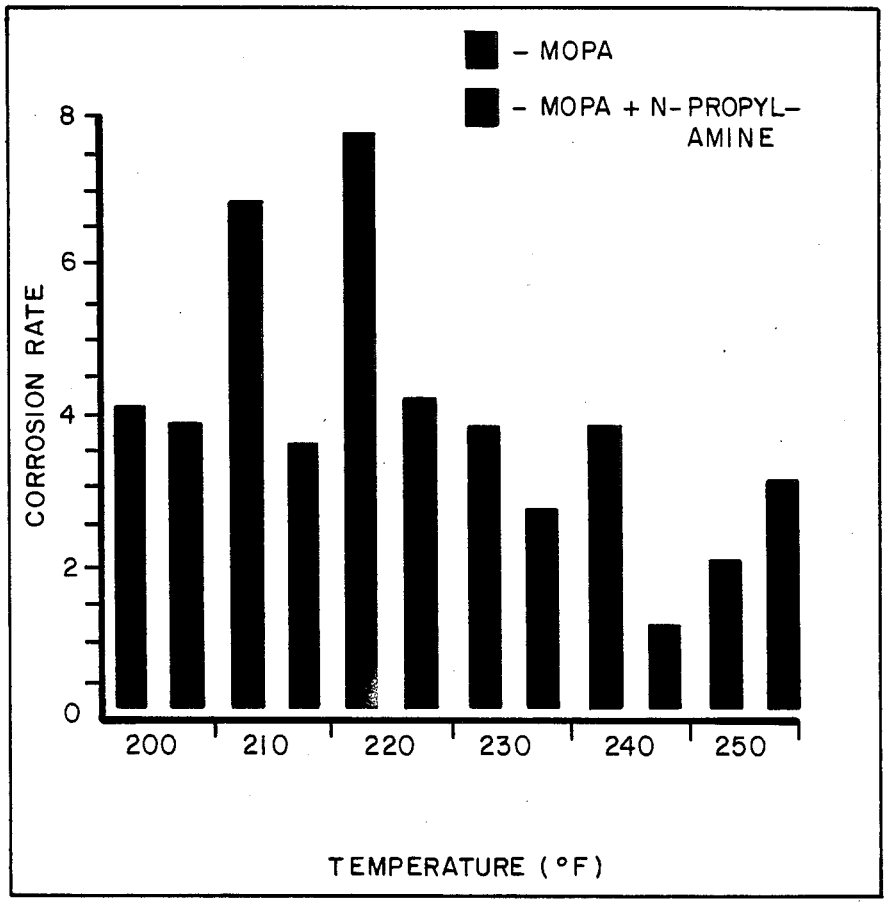

FIG. 4 is a sum of the comparative results obtained by treating an OCS* directly with MOPA and MOPA + n-propylamine. The corrosion peak is 15 to 25 degrees below the measured dew point on this system. Overall there was about 33% improvement in corrosion protection; at the temperatures of peak activity, corrosion was reduced by almost 50%.

*Overhead Corrosion Simulator described in U.S. Pat. No. 4,335,072.

Having thus described our invention, it is claimed as follows:

1. A process for substantially neutralizing $SO_2$ and water present in the condensate of a distilling petroleum product which comprises treating the distilling product prior to the condensation thereof with at least one amine having a normal boiling point below 95° C. in an amount sufficient to substantially neutralize all of the $SO_2$ present with said petroleum product.

2. The process of claim 1 where the distilling product is also treated with a film-forming inhibitor having the the general structural formula:

$$R-\overset{\overset{R_2}{|}}{N}-R_3$$

where R is an aliphatic hydrocarbon radical of 8 to 22 carbon atoms in chain length and both $R_2$ and $R_3$ are selected from the group consisting of hydrogen and an aliphatic hydrocarbon radical of 1 to 22 carbon atoms in chain length.

3. A process for substantially neutralizing acidic components in the aqueous condensate of a distilling petroleum product which contains water, HCl, and $SO_2$ which comprises treating the distilling product prior to water condensation thereof with at least one amine having a boiling point below 95° C. in an amount sufficient to substantially neutralize all of the $SO_2$ present in said petroleum product and also treating said distilling product with at least one amine having a boiling point at or above 95° C. in an amount sufficient to substantially neutralize the HCl present in said petroleum product.

4. The process of claims 1 or 3 where the organic amine having a boiling point below 95° C. is selected from the group consisting of dimethylamine, n-propylamine, ethylamine, methylamine, isopropylamine, or a mixture thereof.

5. The process of claim 3 where the organic amine having a boiling point below 95° C. is dimethylamine, n-propylamine, ethylamine, methylamine, isopropylamine, or mixtures thereof, and the amine having a boiling point at or above 95° C. is selected from the group consisting of methoxypropylamine, N,N-dimethylethanolamine, N,N-dimethylisopropanolamine, N,N-diethylethanolamine, monoethanolamine, ethylenediamine, morpholine, mixtures of N,N-dimethylethanolamine and N,N-dimethylisopropanolamine, mixtures of methoxypropylamine, monoethanolamine, and morpholine, and mixtures of N,N-dimethylisopropanolamine and monoethanolamine.

6. The process of claim 3 where the organic amine having a boiling point below 95° C. is dimethylamine, n-propylamine, ethylamine, methylamine, isopropylamine, or mixtures thereof and the amine having a boiling point at or above 95° C. is methoxypropylamine.

7. The process of claim 3 where the distilling product is also treated with a film-forming inhibitor having the general structural formula:

$$R-\overset{\overset{\displaystyle R_2}{|}}{N}-R_3$$

where R is an aliphatic hydrocarbon radical of 8 to 22 carbon atoms in chain length and both $R_2$ and $R_3$ are selected from the group consisting of hydrogen and an aliphatic hydrocarbon radical of 1 to 22 carbon atoms in chain length.

* * * * *